US009707585B2

(12) United States Patent
Reimert

(10) Patent No.: US 9,707,585 B2
(45) Date of Patent: Jul. 18, 2017

(54) CHANGER DEVICE FOR COATING MEDIA AND COATING SYSTEM FOR COATING OBJECTS

(71) Applicant: Eisenmann SE, Boeblingen (DE)

(72) Inventor: Christian Reimert, Wolfsburg (DE)

(73) Assignee: EISENMANN SE, Boeblingen (DE)

( * ) Notice: Subject to any disclaimer, the term of this patent is extended or adjusted under 35 U.S.C. 154(b) by 0 days.

(21) Appl. No.: 14/783,506

(22) PCT Filed: Mar. 29, 2014

(86) PCT No.: PCT/EP2014/000849

§ 371 (c)(1),
(2) Date: Oct. 9, 2015

(87) PCT Pub. No.: WO2014/166602

PCT Pub. Date: Oct. 16, 2014

(65) Prior Publication Data

US 2016/0074892 A1 Mar. 17, 2016

(30) Foreign Application Priority Data

Apr. 11, 2013 (DE) ..... 10 2013 006 219

(51) Int. Cl.
*B05B 12/14* (2006.01)
*B05B 15/02* (2006.01)

(52) U.S. Cl.
CPC ..... *B05B 12/149* (2013.01); *B05B 12/1481* (2013.01); *B05B 15/025* (2013.01)

(58) Field of Classification Search
CPC ... B05B 12/14; B05B 12/1481; B05B 12/149; B05B 15/025
USPC ..... 239/112
See application file for complete search history.

(56) References Cited

U.S. PATENT DOCUMENTS 3,637,136 A * 1/1972 Bok ..... B05B 9/0403 118/302
3,674,205 A 7/1972 Kock
3,752,398 A * 8/1973 Svensson ..... B01F 15/00025 134/18

(Continued)

FOREIGN PATENT DOCUMENTS

DE 43 29 101 A1 3/1995
DE 201 22 759 U1 8/2007

(Continued)

*Primary Examiner* — Darren W Gorman
(74) *Attorney, Agent, or Firm* — Factor Intellectual Property Law Group, Ltd.

(57) ABSTRACT

A changer device for coating media having a housing, which has a delivery port which can be connected to an application device. At least one change unit is provided which includes at least a first and second inlet port, at least one outlet port and a valve device which may connect the first inlet port or the second inlet port to the outlet port, or which may block the flow channel to the outlet port. The valve device may be a rotating element and/or sliding element that is arranged in a valve chamber and includes a plurality of passage ducts which are able to connect fluidically the outlet port with one or both of the at least two inlet ports of the changer unit. The at least one such change unit may be provided in a coating system for coating objects with an application device and a plurality of reservoirs.

9 Claims, 5 Drawing Sheets

(56) References Cited

U.S. PATENT DOCUMENTS

| | | | | |
|---|---|---|---|---|
| 4,375,865 | A * | 3/1983 | Springer | B05B 12/14 118/302 |
| 5,944,045 | A | 8/1999 | Allen et al. | |
| 2009/0202731 | A1 * | 8/2009 | Kazkaz et al. | B05B 5/1633 427/421.1 |

FOREIGN PATENT DOCUMENTS

| | | | |
|---|---|---|---|
| EP | 2 361 691 | A1 | 8/2001 |
| EP | 2 075 073 | A1 | 7/2009 |
| EP | 2 554 275 | A1 | 2/2013 |
| JP | S5645780 | A | 4/1981 |

* cited by examiner

CHANGER DEVICE FOR COATING MEDIA AND COATING SYSTEM FOR COATING OBJECTS

RELATED APPLICATIONS

This application is a national phase of International Patent Application No. PCT/EP2014/000849, filed Mar. 29, 2014, which claims the filing benefit of German Patent Application No. 10 2013 006 219.5, filed Apr. 11, 2013—the contents of both of which are incorporated herein by reference.

FIELD OF THE INVENTION

The invention relates to a changing device for coating media, in particular for paints, having a) a housing, which has an outlet duct which is connectable to an application device;

b) at least one changing unit, which for its part comprises:

ba) at least one first inlet duct and one second inlet duct;

bb) at least one outlet duct;

bc) a valve member, by which the first inlet duct or the second inlet duct is connectable to the outlet duct or the flow path to the outlet duct is blockable.

Furthermore, the invention relates to a coating system for coating objects having a) an application device;

b) a plurality of reservoirs for respectively one coating medium;

c) at least one changing device having a plurality of inlet ducts, each of which is connected to its own reservoir for coating medium, and at least one outlet duct, which is connected to the application device, and through which selectively a coating medium is conductible from a reservoir to the application device.

BACKGROUND OF THE INVENTION

For example, in the case of a painting plant a changing device for coating media, i.e. then a colour changing device, is employed when in normal operation it relatively frequently occurs that for the coating of an object a different paint is to be used than the paint with which a previous object was painted.

In the case of a colour change, the previously used paint has to be cleaned from the media-conducting ducts and lines, for which purpose a flushing agent is conveyed through the corresponding ducts and lines. In order to keep paint losses and the required quantities of flushing agent as low as possible, the so-called pigging technique is often employed, in which the coating media or the flushing agent are pushed through the ducts and lines with the aid of pigs.

In the case of changing devices and coating systems known from the market, the use of seat valves, the valve member of which is a closing element which cooperates classically with a valve seat, has become established. Such changing devices generally comprise a common flow duct which is used for all media.

Overall, in such and also in other known systems, the volume of the media-conducting ducts and lines from which a coating medium or flushing agent cannot be recovered is comparatively large. This is due, on the one hand, to the fact that many ducts and lines in such a changing device cannot be traversed by a pig. On the other hand, there are many components and parts with projections or undercuts or the like, such as line junctions or valve seats, which come into contact with paint and quite a lot of flushing agent has to be used to free all such places perfectly from paint that is present, regardless of whether the place concerned is piggable or not.

SUMMARY OF THE INVENTION

An object of the invention is to provide a changing device and a coating system of the kind mentioned at the outset which take account of these concerns.

This object may be achieved in the case of a changing device of the kind mentioned at the outset in that c) the valve member of the changing unit is formed as a rotary member and/or sliding member arranged in a valve chamber, which member comprises a plurality of through-ducts which, depending on the position of the valve member, can fluidically connect the outlet duct to one or both of the at least two inlet ducts of the changing unit.

In this way, there is provided a changing device in which seat valves can be dispensed with, so that there are fewer junctions which are difficult to clean in the possible flow paths, and this can reduce at least the amount of flushing agent that may be required.

In practice, it is favourable when the outlet duct of the at least one changing unit defines the outlet duct of the changing device. The outlet duct of the changing unit can thus serve, for example, directly for connecting a supply line to the application device.

Moreover, advantageously at least one through-duct of the valve member can be piggable. In this way, coating medium which is situated in the piggable through-duct of the valve member after completion of the application operation can, in a return phase, be pushed substantially completely back into the associated reservoir by means of a pig and thus recovered.

Technically it is particularly favourable when the valve member is a rotary member and the rotary member is disc-like or a rotary sphere or a rotary cone or a rotary cylinder.

When the rotary member is disc-like, it is advantageous when the through-ducts extend radially through the rotary member. Media-conducting ducts can be accommodated well in the constructional space radially next to the valve chamber.

In order to increase the functionality of the changing device, it is favourable when the changing unit is a first changing unit and the changing device comprises at least a second changing unit in accordance with the above features b), ba), bb), bc) and c), the outlet duct of the second changing unit being fluid-tightly connected to an inlet duct of the first changing unit. As a result, the changing device can cooperate with further reservoirs for coating media.

A great variability is achieved when the changing device is constructed in a modular fashion from at least two changing units, which are formed as separate changing modules. Depending on the reservoirs present and to be used, two, three or more such changing modules can then be combined to form the changing unit.

With regard to the coating system of the kind mentioned at the outset, the above-mentioned object may be achieved in that d) the changing device is a changing device having some or all of the features explained above.

The advantages achieved by this correspond to the advantages explained above regarding the changing device.

Furthermore, it is particularly favourable when a separate pig is associated with each inlet duct, which is connected to its own reservoir for coating medium.

Thus, a good media separation can be achieved and a pig can remain in a parked position when coating medium from that reservoir with which the pig is associated is not being applied.

In principle, the coating system having the changing device can be operated without specially provided flushing operations, since owing to the basic construction neither in the coating system nor in the changing device are there flow paths remaining that are used by a plurality of media and cannot be cleaned by a pig. If nevertheless a cleaning is desired or prescribed, advantageously at least one inlet duct can be connected to a flushing-agent reservoir for flushing agent.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention are explained in more detail below with the aid of the drawings, in which.

DETAILED DESCRIPTION OF THE PRESENT INVENTION

Figure 1:
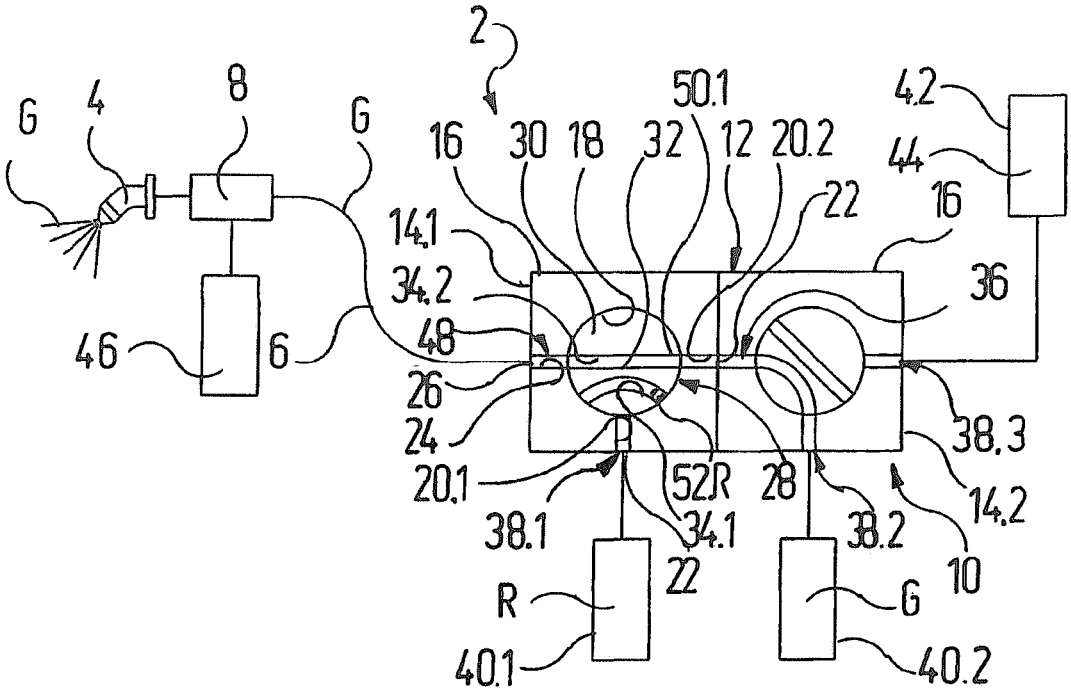
FIG. 1 schematically shows a first exemplary embodiment of a colour changing device, which comprises two valve members in the form of rotary members and is connected to an application device, each rotary member having two piggable through-ducts and the colour changing device being shown in a first application phase, in which it assumes a first application configuration.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

A coating system for applying coating media is designated in FIG. 1, as a whole, by 2, which system comprises an application device 4. In the present case, by way of example, a coating system 2 for paints is described. In this case, the application device may, for example, be a spray gun or a high-speed rotary atomiser, as is known per se. When a connection of ports, ducts or lines is mentioned hereinafter, primarily this means respectively a fluidic connection of such components, whereby corresponding flow paths are formed.

The application device 4 is fed via a supply line 6. The coating system 2 is operated in a manner known per se using the pigging technique, which is why a pig station 8 is arranged in close proximity to the application device 4 in the supply line 6. At the end remote from the application device 4, the supply line 6 is connected to a changing device 10 for coating media, a first exemplary embodiment of which is shown in FIGS. 1 to 5.

The changing device 10 has a housing 12 and comprises, in the present exemplary embodiment, two changing units 14, which are designated by 14.1 and 14.2 and are of identical design and are explained below with reference to the changing unit 14.1.

The changing unit 14.1 comprises a housing 16, in which a valve chamber 18 is accommodated. The valve chamber 18 is fluidically connected, via a first inlet duct 20.1 and a second inlet duct 20.2, respectively to an inlet port 22 which is arranged at the outer side of the housing 16. Furthermore, an outlet duct 24 leads from the valve chamber 18 to an outlet port 26, likewise arranged at the outer side of the housing 16.

A valve member 28 is arranged in the valve chamber 18, the valve chamber 18 and the valve member 28 being formed complementary to one another. In the present exemplary embodiment, the valve member 28 is formed as a disc-like rotary member 30 with circular outer contour, which member in a manner known per se forms a seal with respect to the inner circumferential surface of the valve chamber 18 of corresponding complementary circular shape. The rotary member 30 is mounted rotatably about a central axis of rotation 32 and has through-ducts 34 which extend in the radial plane through the rotary member 30.

In the present exemplary embodiment, two through-ducts, designated by 34.1 and 34.2, are present. These through-ducts 34.1 and 34.2 have such a course that, in a first rotary position of the rotary member 30, the first inlet duct 20.1 can be connected to the outlet duct 24 by the first through-duct 34.1 and, in a second rotary position of the rotary member 30, the second inlet duct 20.2 can be connected to the outlet duct 24 by the second through-duct 34.2. Thus, FIG. 1 shows the rotary member 30 of the changing unit 14.1 in its second rotary position and the rotary member 30 of the changing unit 14.2 in its first rotary position.

In general terms, the first inlet duct 20.1 or the second inlet duct 20.2 can be connected to the outlet duct 24 by the valve member 28. A blocking position of the valve member 28 is also possible, in which the flow path to the outlet duct 24 is blocked.

In the present exemplary embodiment, the inlet duct 20.2 of the first changing unit 14.1 is fluid-tightly connected to the outlet duct 24 of the second changing unit 14.2, whereby a connecting duct 36 is formed, which connects the valve chamber 18 of the first changing unit 14.1 to the valve chamber 18 of the second changing unit 14.2.

In this way, the changing device 10 has a total of three inlet ducts 38, which are designated by 38.1, 38.2 and 38.3. These inlet ducts 38.1, 38.2 and 38.3 are formed by the first inlet duct 20.1 of the first changing unit 14.1 and by the two inlet ducts 20.1 and 20.2 of the second changing unit 14.2. Their ports 22 are thus also the ports of the inlet ducts 38.

Of these, the first and the second inlet duct 38.1, 38.2 are connected respectively to a paint reservoir 40, which bear the reference symbols 40.1 and 40.2 and in which different paints, in general therefore different coating materials, are held ready. For example, in the first paint reservoir 40.1 there is red paint R and in the second paint reservoir 40.2 there is green paint G. The third inlet duct 38.3, by contrast, is connected to a flushing-agent reservoir 42 for a flushing agent 44. A flushing-agent collecting tank 46 is connected to the pig station 8 at the application device 4. By reservoir there is understood in the present case any technical solution for making available different media. This therefore also includes, for example, ring line systems, as are known per se.

The outlet duct 24 with the outlet port 26 of the first changing unit 14.1 now forms functionally an outlet duct 48 of the changing device 10, to which the above-mentioned supply line 6 for the application device 4 of the coating system 2 is connected.

The coating system 2 with the changing unit 10 now operates as follows:

The changing device 10 can assume two application configurations, a first of which is shown in FIG. 1. In this configuration, the rotary members 30 of the changing units assume a respective rotary position such that a first paint flow path 50.1 is formed between the paint reservoir 40.2 with green paint G and the supply line 6, via the inlet duct 38.2, the through-duct 34.1 in the rotary member 30 of the second changing unit 14.2, the connecting duct 36, the through-duct 34.2 in the rotary member 30 of the first changing unit 14.1 and the outlet duct 48.

In the coating system 2, each paint has its own pig 52 associated therewith. In the application phase illustrated in FIG. 1, a pig 52.R for the red paint from the paint reservoir 40.1 is situated, in the through-duct 34.1 of the rotary member 30 of the first changing unit 14.1, in a parked position at the end of the through-duct 34.1 which is associated with the inlet duct 20.1 of the first changing unit 14.1. A pig 52.G, which cannot be seen, for the green paint from the paint reservoir 40.2 is situated in the pig station 8 at the application device 4. In the supply line 6 there is thus green paint G which is emitted onto an object (not shown specifically) via the application device 4.

To propel paint or the pigs 52 in the line system formed by the ducts and lines explained, media pressure of paint, flushing agent, air, $CO_2$, nitrogen and the like can be used, which are provided in a manner known per se. Components required therefor, such as media sources, lines, valves and ports, are not shown specifically in the figures for the sake of clarity.

If now a colour change from green paint G to red paint R is to be performed, firstly, in a return phase the green paint G situated in the supply line 6 and the first paint flow path 50.1 is forced back into the paint reservoir 40.2. For this purpose, the pig 52.G is conveyed from the pig station 8 via the supply line 6 through the paint flow path 50.1 until it assumes the parked position explained above, which for the pig 52.G lies at that end of the through-duct 34.1 of the rotary elements 30 of the second changing unit 14.2 which is associated with the inlet duct 20.2 of the second changing unit 14.2.

Figure 2:
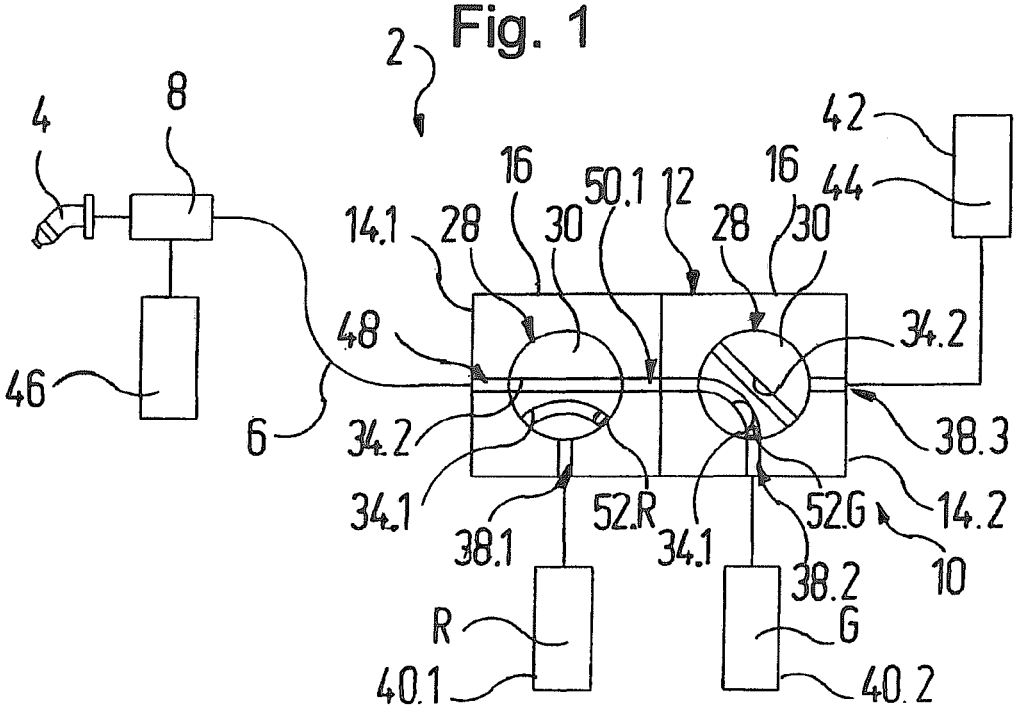
FIG. 2 shows the colour changing device of FIG. 1 in a return phase of a colour change, in which the colour changing device still assumes its first application configuration.

This is illustrated in FIG. 2, where merely the most important parts of the colour changing device 10 are provided with a reference symbol. This also applies to FIGS. 3 to 5.

On its path from the pig station 8 to this parked position, the pig 52.G pushes the green paint in front of it and back into the paint reservoir 40.2.

Figure 3:
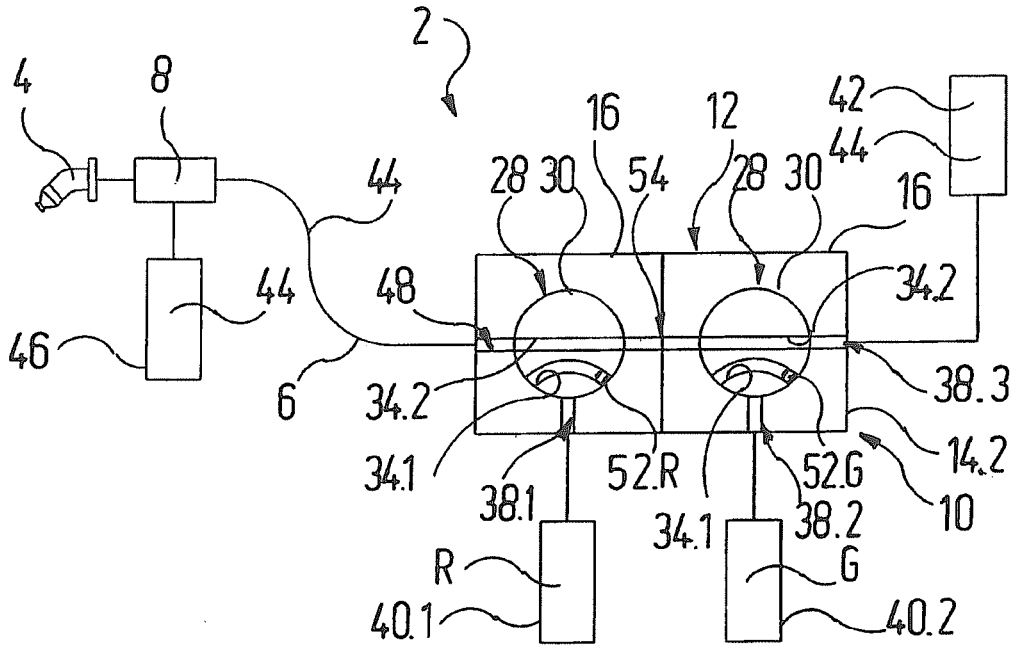
FIG. 3 shows the colour changing device of FIG. 1 in a flushing phase of a colour change, in which the colour changing device assumes a flushing configuration.

Now a flushing operation can optionally be performed. In such a flushing operation, the changing device 10 is brought into a flushing configuration, which is illustrated in FIG. 3. In this flushing configuration, both rotary members 30 of the first and of the second changing unit 14.1, 14.2 assume their second rotary position, so that the changing device 10 connects the flushing-agent reservoir 42 to the supply line 6 and a flushing flow path 54 is formed in the changing device 10 between its inlet duct 38.3 and its outlet duct 48.

Then flushing agent 44 is forced by means of compressed air from the flushing-agent reservoir 42 through the flushing flow path 54 in the changing device 10 and further through the supply line 6 through the pig station 8 and through the application device 4, some of which agent is caught in a collecting tank (not shown).

When the application device 4 has been cleaned, the flushing agent 44 is forced from the supply line 6 into the flushing-agent collecting tank 46.

The pigging technique can also be used for flushing the coating system 2 and the changing device 10, as is known per se. In the present case, a flushing-agent pig would have associated therewith a parked position in the through-duct 34.2 in the rotary member 30 of the second changing unit 14.2.

Figure 4:
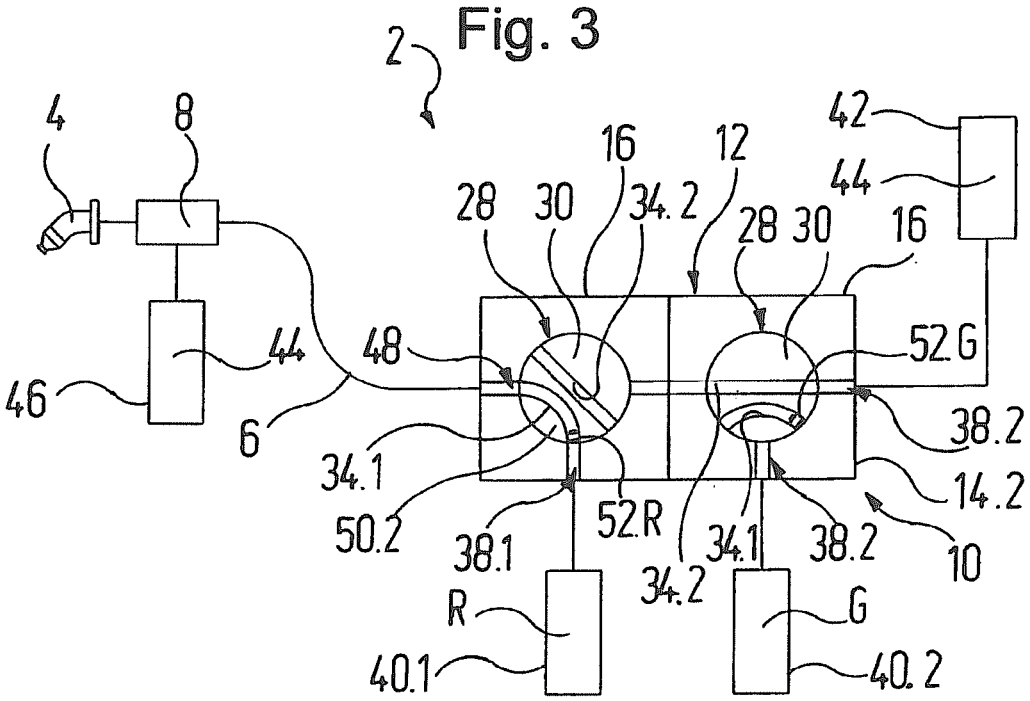
FIG. 4 shows the colour changing device of FIG. 1 in a change-over phase of a colour change, in which the colour changing device assumes a second application configuration.

After the flushing operation has been completed, the changing device 10 is brought in a change-over phase into its second application configuration, which is shown in FIG. 4. In this configuration, the rotary members 30 of the changing units assume a respective rotary position such that a second paint flow path 50.2 is formed between the paint reservoir 40.1 with red paint R and the supply line 6, via the inlet duct 38.1, the through-duct 34.1 in the rotary member 30 of the first changing unit 14.1 and the outlet duct 48. For this purpose, the rotary element 30 of the first changing unit 14.1 is rotated from its second rotary position into its first rotary position, while the rotary element 30 of the second changing unit 14.2 can remain unchanged in its second rotary position.

Figure 5:
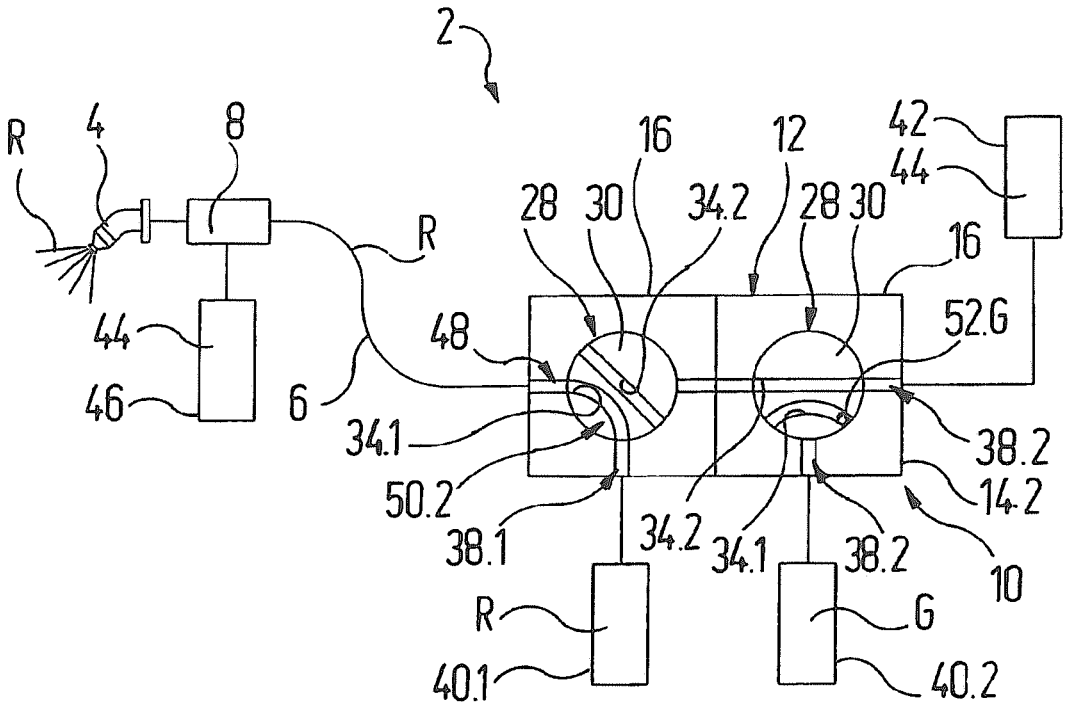
FIG. 5 shows the colour changing device of FIG. 1 in a second application phase, in which the colour changing device assumes the second application configuration.

Red paint R from the paint reservoir 40.1 is forced into the inlet duct 38.1 of the changing device 10 and through the paint flow path 50.2 and the supply line 6 to the application device 4. The pig 52.R is pushed by the red paint R to the pig station 8, where it remains for the duration of the coating with red paint R. This application phase is illustrated in FIG. 5, in which the pig 52.R can accordingly no longer be seen.

When the coating with red paint R has been completed and a colour change is to take place, a flushing operation can again optionally be performed, as was explained above and illustrated in FIG. 2.

It is also possible to dispense with a respective flushing operation on a colour change if the media-conducting lines and ducts are sufficiently cleaned by the associated pig 52 which pushes the current coating medium back into the reservoir 40.

In the exemplary embodiment according to FIGS. 1 to 5, therefore, a further paint reservoir 40 with a further paint may also be present instead of the flushing-agent reservoir 42. In this case, the flushing configuration explained above with reference to FIG. 3 corresponds to a third application configuration.

Since the coating system 2 explained above, as well as the exemplary embodiments still to be explained below, are operated using the pigging technique, all lines and ducts between the respective parked position of the pigs 52 and the pig station 8 are piggable and, as regards their structure, for example as regards their dimensions and curvatures, comply with the requirements which have to be met in order that a pig can pass through the lines and ducts. With regard to the changing device 10, at least one through-duct 34 in the valve member 28 is piggable, so that at least this through-duct 34 can be used for coating material using the pigging technique.

The presence or absence of the pigs 50 in the pig station 8 or in the respective parked positions can be ascertained with the aid of established detection methods. Suitable for this are, in a known manner, for example proximity sensors, magnetic eddy probes, light barriers and light-guiding and ultrasonic techniques or a determination of the pig positions by pressure or quantity measurements based on the conveyed coating medium.

In modifications (not shown specifically), the operation may also take place without pigs. The cleaning of the system on a colour change then takes place only via the flushing agent.

Overall, the loss of paint on a colour change is very low and is in the largely limited to the paint which is situated between the pig station 8 and the application device 4 and which is blown out via the application device 4. This amount of paint may decrease all the more as the distance between the application device 4 and the pig station 8 decreases.

Figure 6:
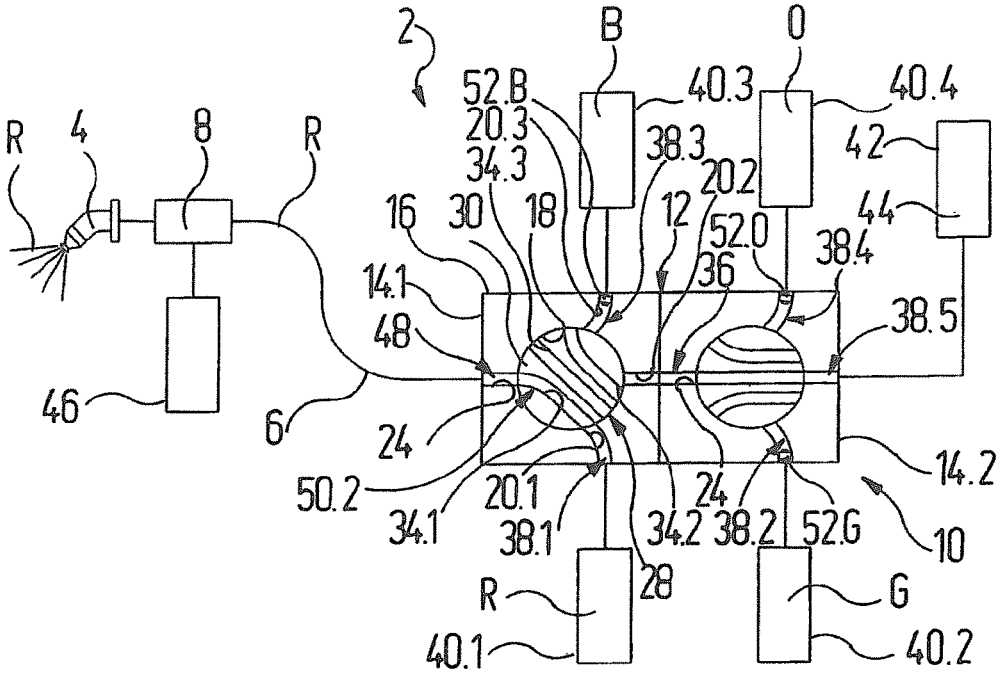
FIG. 6 schematically shows a second exemplary embodiment of a colour changing device, which comprises two valve members in the form of rotary members and each rotary member has three piggable through-ducts.

In FIG. 6, a coating system 2 having a second exemplary embodiment of a changing device 10 is shown. Components and parts already explained in the coating system 2 according to FIGS. 1 to 5 bear the same reference symbols in FIG. 6. There the changing device 10 has two changing units 14.1 and 14.2, each of which has not only two, but three inlet ducts 20.1, 20.2 and 20.3; these ducts and also other components are only designated in the case of the changing unit 14.1, for the sake of clarity. There too the inlet duct 20.2 of the first changing unit 14.1 is fluid-tightly connected to the outlet duct 24 of the second changing unit 14.2, and the connecting duct 36 which connects the valve chamber 18 of the first changing unit 14.1 to the valve chamber 18 of the second changing unit 14.2 is formed. The changing unit 10 here has a total of five inlet ducts 38, of which four inlet ducts 38.1, 38.2, 38.3 and 38.4 are connected respectively to a paint reservoir 40.1, 40.2, 40.3 and 40.4, in which, for example, red paint R, green paint G, blue paint B and orange paint O are situated. The fifth inlet duct 38.5 is connected to the flushing-agent reservoir 42. If no flushing operations are required, a paint reservoir 40 may also be connected here.

In total the rotary members 30 in this exemplary embodiment can be adjusted into respectively three rotary positions, whereby the changing device 10 can assume four application configurations and one flushing configuration or a fifth application configuration. Of the possible application configurations, FIG. 6 shows one such configuration in which the paint reservoir 40.1 with the red paint R is conveyed to the application device 4 and emitted by the latter. The associated pig 52.R is again situated in the pig station 8 and therefore cannot be seen.

The remaining pigs 52.G, 52.B and 52.0 are situated respectively in their parked position. As FIG. 6 shows, here this does not lie inside the respective rotary member 30, but is arranged at the respective inlet port 22 of each inlet duct 38 of the changing device 10. Both variants are fundamentally possible in all embodiments of the changing device 10.

The disc-like rotary member 30 shown in the changing devices 10 according to FIGS. 1 to 6 is merely one example of a possible configuration of a valve member 28 as a rotary member. In modifications (not shown specifically) the valve members 28 may, for example, also be produced as a rotary sphere, rotary cone or rotary cylinder or the like. In the case of a rotary cylinder, the through-ducts 34 can run through the rotary cylinder radially or in the axial direction between the end faces. In the latter case, a kind of "revolver function" can be provided.

Figure 7:
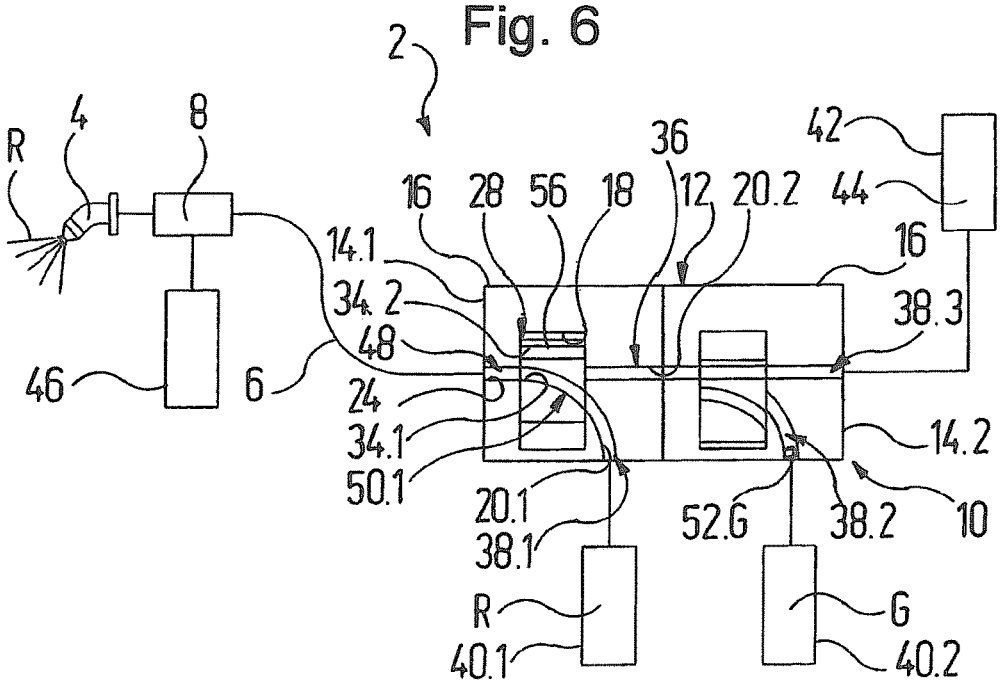
FIG. 7 schematically shows a third exemplary embodiment of a colour changing device, which comprises two valve members in the form of sliding members and each sliding member has two piggable through-ducts.

FIG. 7 shows a coating system 2 having a third exemplary embodiment of a changing device 10. There too, components and parts already explained in the coating systems 2 according to FIGS. 1 to 6 bear the same reference symbols. The changing device 10 there again has two changing units 14.1 and 14.2 having respectively two inlet ducts 20.1, 20.2, so that the changing device has three inlet ducts 38.1, 38.2 and 38.3.

The valve member 28 there is not a rotary member, but a sliding member 56, in which the through-ducts 34.1 and 34.2 are formed. The sliding member 56 and the respective chamber 18 of the changing units 14.1, 14.2 are again of complementary form, so that the sliding member 56 can be fluid-tightly displaced in the valve chamber 18, in order to connect flow paths, which differ from one another between the individual inlet ducts 20.1, 20.2 of the changing unit 14.1 or 14.2 concerned, to the outlet duct 24 thereof.

In the case of a changing device 10 having sliding members 56 too, the changing units 14.1, 14.2 can have further inlet ducts 20 and the sliding members 56 accordingly further through-ducts 34.

Otherwise, the above statements regarding the changing devices 10 according to FIGS. 1 to 6 apply analogously.

Figure 8:
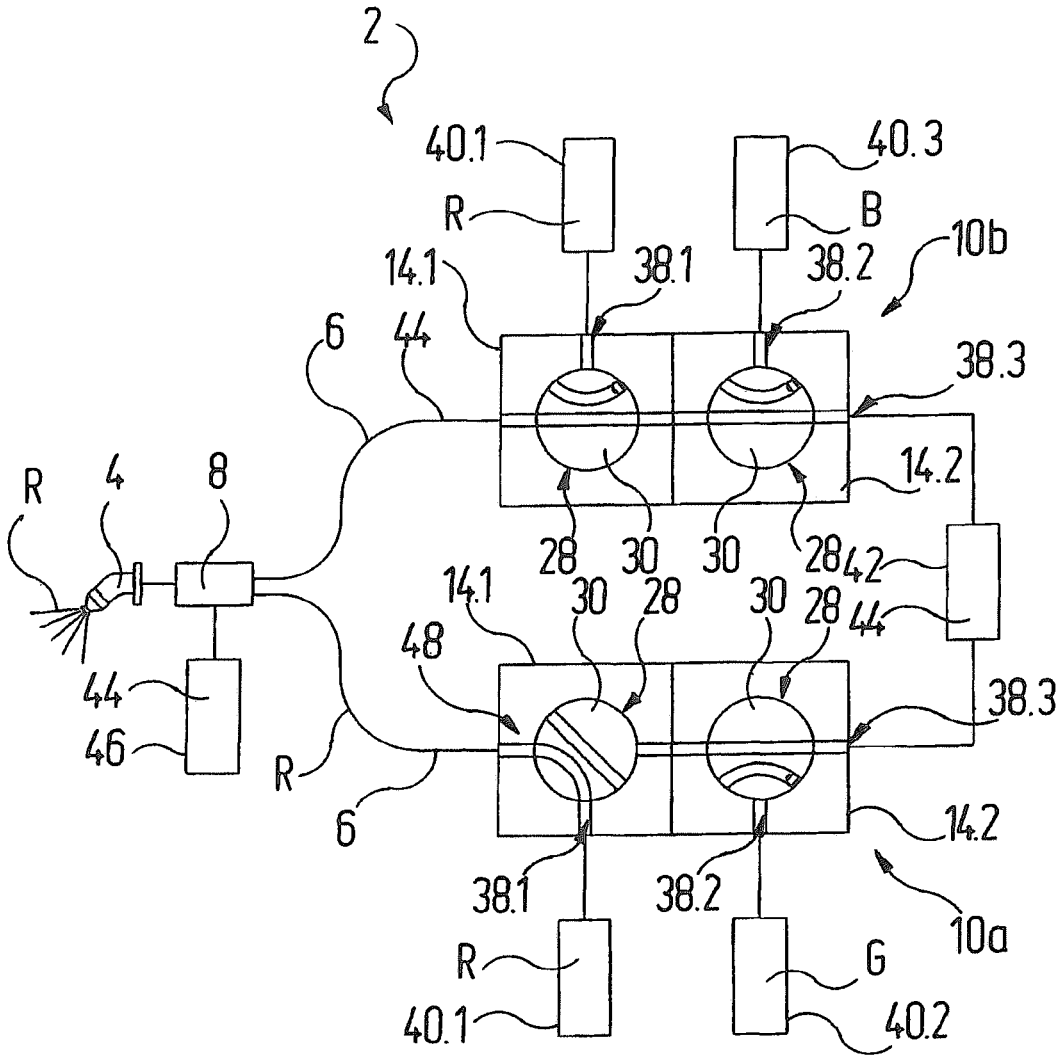
FIG. 8 shows a coating system, in which two changing devices are operated in parallel.

In FIG. 8 there is shown a coating system 2, in which two changing device 10 are operated in parallel, two changing units 10 according to FIGS. 1 to 5, designated by 10*a* and 10*b*, being shown by way of example.

There, by way of example, the inlet ducts 38.1, 38.2 of the lower changing device 10*a* in FIG. 8 are connected to the reservoir 40.1 with red paint R and to the reservoir 40.2 with green paint G, respectively, while the inlet ducts 38.1, 38.2 of the upper changing device 10*b* in FIG. 8 are connected to a further reservoir 40.1 with red paint R and a reservoir 40.3 with blue paint B. The inlet ducts 38.3 of both changing devices 10 are fed from a common flushing-agent reservoir 42 for flushing agent 44.

From each outlet duct 48 of the two changing devices a separate supply line 6 leads to the pig station 8, which is designed accordingly for this dual operation.

Compared with a coating system 2 having only one changing device 10, here a colour change can take place more quickly. While, for example, red paint R is being applied via the changing device 10*a*, the changing device 10*b* and its supply line 6 as far as the pig station 8 can already be flushed. After this flushing operation, it is then already possible to supply the next paint, e.g. blue paint from the reservoir 40.3, as far as the pig station 8. The section of the supply line 6 between the pig station 8 and the application device 4 can be flushed, on a colour change, with flushing agent from the flushing-agent reservoir 46 via the pig station 8.

Such a parallel or alternating operation of two changing devices is known per se and therefore does not need to be explained further.

In all exemplary embodiments the valve members 28 can be rotated or translated pneumatically, hydraulically or electrically, for which purpose correspondingly driven actuators are present if necessary, these being of no further interest here and therefore not shown specifically. Moreover, the valve members 28 may, if necessary, assume one or more maintenance positions in which, for example, access to the pigs 52 is enabled, in order to facilitate a pig change.

In a modification (not shown specifically), the valve member 28 can also be formed as a rotary and sliding member, so that a change of the flow path can be brought about by rotation and/or translation of the valve member 28.

All changing devices 10 can comprise, instead of two changing units 14.1, 14.2, also only a single changing unit 14 or more than two changing units 14.1, 14.2, . . . , **14.*n***.

Furthermore, changing units 14 present can also have more or fewer inlet ducts 20 than described above and a changing device 10 can also comprise a plurality of differently formed changing units 14. More than one outlet duct 48 can also be present, so that media can be conveyed via one and the same changing device 10 to more than one consumer.

The changing device 10 can also be formed as a constructional unit in the form of a changing block which comprises the individual changing units 14 in an integrated manner. The respective changing units 14 can, however, also be produced as a changing module, so that their housing 16 defines respectively a separate module housing. The changing device 10 itself can then be constructed in modular fashion from individual ones of such changing modules, so that it can be adapted to the number of required or already present paint reservoirs 40 and/or flushing-agent reservoirs. For this purpose, the individual changing modules comprise mutually complementary fastening means, so that the changing modules can be securely fastened to one another and a fluid-tight connection is ensured.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A changing device for coating media comprising:

a) a housing, which has a housing outlet duct which is connectable to an application device;

b) at least one changing unit, which comprises:

ba) at least one first inlet duct and one second inlet duct;

bb) at least one outlet duct;

bc) a valve member, by which the at least one first inlet duct or the second inlet duct is connectable to the at least one outlet duct or the flow path to the at least one outlet duct is blockable, wherein c) the valve member of the at least one changing unit is formed as a rotary member and/or sliding member arranged in a valve chamber, which member comprises a plurality of through-ducts which, depending on the position of the valve member, can fluidically connect the at least one outlet duct to one or both of the one first inlet duct and the second inlet duct of the at least one changing unit, and further wherein d) the at least one changing unit is a first changing unit and the changing device comprises at least a second changing unit substantially identical to the first changing unit, the at least one outlet duct of the second changing unit being fluid-tightly connected to at least one of the at least one first inlet duct and the second inlet duct of the first changing unit.

2. The changing device according to claim 1, wherein the at least one outlet duct of the at least one changing unit defines the housing outlet duct of the changing device.

3. The changing device according to claim 1, wherein at least one through-duct of the plurality of through-ducts of the valve member is piggable.

4. The changing device according to claim 1, wherein the valve member is a rotary member and the rotary member is disc-like or a rotary sphere or a rotary cone or a rotary cylinder.

5. The changing device according to claim 4, wherein the rotary member is disc-like and the through-ducts extend radially through the rotary member.

6. The changing device according to claim 1, wherein the changing device is constructed in a modular fashion from at least two changing units, which are formed as separate changing modules.

7. A coating system for coating objects comprising:

a) an application device;

b) a plurality of reservoirs each having one coating medium;

c) at least one changing device having a plurality of inlet ducts, each of the plurality of inlet ducts being connected to its own reservoir from the plurality of reservoirs, and at least one outlet duct, which is connected to the application device, and through which selectively a coating medium is conductible from one of the plurality of reservoirs to the application device;

wherein d) the at least one changing device comprises:

a housing, which has a housing outlet duct which is connectable to the application device;

at least one changing unit, which comprises:

at least one first inlet duct and one second inlet duct;

at least one outlet duct;

a valve member, by which the at least one first inlet duct or the second inlet duct is connectable to the at least one outlet duct or the flow path to the at least one outlet duct is blockable, wherein the valve member of the at least one changing unit is formed as a rotary member and/or sliding member arranged in a valve chamber, which member comprises a plurality of through-ducts which, depending on the position of the valve member, can fluidically connect the at least one outlet duct to one or both of the at least one first inlet duct and the second inlet duct of the at least one changing unit, and further wherein the at least one changing unit is a first changing unit and the changing device comprises at least a second changing unit substantially identical to the first changing unit, the at least one outlet duct of the second changing unit being fluid-tightly connected to at least one of the at least one first inlet duct and the second inlet duct of the first changing unit.

8. The coating system according to claim 7, wherein each inlet duct from the plurality of inlet ducts has a pig associated therewith, each pig being associated with one reservoir from the plurality of reservoirs.

9. The coating system according to claim 7, wherein at least one inlet duct from the plurality of inlet ducts is connected to a flushing-agent reservoir for flushing agent.

* * * * *